United States Patent [19]

Yasuda et al.

[11] 4,265,969

[45] May 5, 1981

[54] METHOD FOR MANUFACTURING CAST-COATED PAPER

[75] Inventors: Nobu Yasuda; Masafumi Masuda; Tomoichi Morita, all of Tokyo, Japan

[73] Assignee: Mitsubishi Paper Mills, Ltd., Tokyo, Japan

[21] Appl. No.: 40,154

[22] Filed: May 17, 1979

[30] Foreign Application Priority Data

May 19, 1978 [JP] Japan ..... 53-59594
May 26, 1978 [JP] Japan ..... 53-62989

[51] Int. Cl.[3] ..... B05D 3/02; B05B 3/06; B05D 3/12; B32B 23/08

[52] U.S. Cl. ..... 428/342; 427/44; 427/45.1; 427/53.1; 427/55; 427/362; 427/366; 427/391; 427/411; 428/512; 428/513; 428/514; 427/358

[58] Field of Search ..... 427/362, 366, 391, 411, 427/44, 45.1, 53.1, 55, 358; 428/342, 512, 513, 514

[56] References Cited

U.S. PATENT DOCUMENTS

| | | | |
|---|---|---|---|
| 2,759,847 | 8/1956 | Frost et al. | 427/362 X |
| 3,377,192 | 4/1968 | Kirk et al. | 427/362 X |
| 3,583,881 | 6/1971 | Kennedy | 427/362 |
| 3,873,345 | 3/1975 | Vreeland | 427/391 X |
| 4,048,380 | 9/1977 | Blakey et al. | 427/362 X |

*Primary Examiner*—Michael R. Lusignan
*Attorney, Agent, or Firm*—Cushman, Darby & Cushman

[57] ABSTRACT

High quality cast-coated paper is obtained with high productivity by applying an aqueous coating composition containing a coating pigment and a binder to the surface of base paper by means of a blade coater to form an undercoating layer, the application rate being from 5 to 25 g/m$^2$ on dry basis per side; then applying to said undercoating layer an aqueous coating composition containing a coating pigment and a polymer latex having a glass transition point of 38° C. or higher to form an overcoating layer, drying said overcoating layer at a temperature below the glass transition point of the latex in said overcoating layer; and subjecting it to mirror finish treatment at a temperature higher than said glass transition point.

9 Claims, No Drawings

METHOD FOR MANUFACTURING CAST-COATED PAPER

This invention relates to a method for manufacturing cast-coated paper, particularly both-side cast-coated paper.

The term "cast-coated paper," as herein referred to, means, as generally accepted in the art, a glossy paper having a specular gloss of 15% or more. The gloss as above and herein expressed is a ratio (in %) of light regularly reflected by the paper specimen over incident light, where angles of incidency and reflection are each 20° to the normal of the paper specimen.

Conventionally known methods for manufacturing cast-coated paper include (1) wet casting method in which a wet coating layer is pressed against a heated smooth finishing surface to effect drying (for example, Japanese Patent Publication No. 25,160/63, (2) rewet casting method in which a wet coating layer is first dried, then rewet to plasticize the coating layer, and the rewetted layer is pressed against a heated smooth finishing surface to effect drying (for example, U.S. Pat. No. 2,759,847), and (3) gelation casting method in which a wet coating layer is changed into a gel state and pressed against a heated smooth finishing surface to effect drying (for example, Japanese Patent Publication, 15,751/63; U.S. Pat. No. 3,377,192).

All of these methods are basically the same in that, while being still wet and held in a plastic state, the coating layer containing mineral pigments and binders as major components is pressed against a heated finishing surface to effect drying.

According to aforesaid methods, the wet coating layer must be dried as well as solidified substantially while being pressed against the finishing surface. Consequently, the production speed is by far slower as compared with ordinally coated papers. In fact, the production speed of prior art casting papers is several tenths of that of ordinary coating papers.

Further, in manufacturing a both-side cast-coated paper by the conventional methods, evaporation of water from the second wet pigmented coating layer in contact with a heated finishing surface is markedly hindered by moisture-impermeable layer which has already been finished on the first side. Consequently, the production speed of both-side cast-coated paper has to be made further slower than that of single-side cast-coated paper. Moreover, owing to rapid evaporation of water from the second coating layer during the finishing, the already finished first layer becomes softened, resulting in deterioration of smoothness and gloss, and sometimes in development of blisters, which in the worst case renders the product commercially valueless.

For the above reason, each side of a both-side cast-coated paper is actually inferior to the glossy side of a single-side cast-coated paper in both smoothness and gloss. There is also a general tendency that the first-finished side is inferior in quality to the second-finished side.

An object of this invention is to provide a method of high productivity for manufacturing a cast-coated paper. Another object of this invention is to provide a method for manufacturing a both-side cast-coated paper having no difference in gloss on each side.

According to this invention, there is provided a method for manufacturing cast-coated paper, which comprises applying at least one undercoating of an aqueous coating composition containing coating pigments and a binder to at least one side of the base paper to form at least one undercoating layer, at least one of the undercoatings being applied by means of a blade coater and the application rate of the undercoating being 5 to 25 g/m$^2$ on dry basis per side; then applying onto the undercoating layer an overcoating of an aqueous coating composition containing a coating pigment and polymer latex having a glass transition temperature of 38° C. or higher; drying the overcoating at a temperature below the glass transition temperature of the polymer latex; and subjecting it to a mirror-finishing treatment at a temperature higher than said glass transition temperature.

The coating composition for use in the undercoating according to this invention is an aqueous coating composition containing ordinary paper coating pigments and a binder as major components. The pigments include clay, kaolin, aluminum hydroxide, calcium carbonate, titanium dioxide, barium sulfate, zinc oxide, satin white, plastic pigments and any others, which are available commercially as paper coating pigments. These can be made use of in any combinations suitable for obtaining the required quality.

The binders are protein adhesives such as caseins and soybean proteins; latices of conjugated diene polymers such as styrene-butadiene copolymers and methyl methacrylate-butadiene copolymers; latices of acrylic polymers such as polymers or copolymers of acrylate esters and/or methacrylate esters; latices of vinyl polymers such as ethylene-vinyl acetate copolymers; latices of these polymers modified with functional group-containing monomers; thermosetting synthetic resin adhesives such as polyvinyl alcohol, olefin-maleic anhydride resins and melamine resins; starches such as cationic starches and oxidized starches; and cellulose derivatives such as carboxymethylcellulose and hydroxyethylcellulose. These ordinary paper coating binders can be made use of any combinations. The binder is used in an amount of 2 to 50, preferably 5 to 30 parts by weight for 100 parts by weight of pigments.

The coating solids are 30 to 70% depending on the type of coater being used. The glass transition temperature of the polymer latex, if used, should be below 38° C.

If required, defoamers, dyes, release agents, flow modifiers or other agents may be suitably used.

The undercoating of the above-noted aqueous coating composition according to this invention may be applied as many times as required by means of a size-press, gate roll coater, gravure coater, bar coater, blade coater or roll-blade coater. The coating weight per side is 5 to 25 g/m$^2$, preferably 8 to 15 g/m$^2$ on dry basis. If the undercoating application is less than 5 g/m$^2$ per side, a desired finish of the final product can never be obtained, no matter how much the coating of the overcoating is applied on it. While the number of undercoating layer may be one or more than one, at least one undercoating layer must be applied by means of a blade coater. To carry out the coating most simply, it is suggested to apply a single undercoating layer by means of a blade coating, dry it, and then apply the overcoating layer according to this invention described further hereunder.

The drying of the undercoating may be done by a customary heating technique such as, for example, gas heating, electric heating, steam heating, hot air heating, infrared, micro-wave heating, laser or electronic beam or by contacting the back side of the undercoated paper with a heated roll.

A knack of this invention lies in that an aqueous overcoatings consisting dominantly of paper coating pigments and a polymer latex having a glass transition temperature of 38° C. or higher is applied on the undercoated substrate; the coated paper is then dried at a temperature below the glass transition temperature (Tg) of said polymer, and subjected to mirror finishing treatment at a temperature above Tg of the polymer latex to obtain a cast-coated paper having a specular gloss greater than 15% at an incident angle of 20°.

The pigments for use in the overcoating composition according to this invention are similar to those used in the undercoating composition described above. It was found that the smoothness, paper gloss and ink gloss of the cast-coated paper are further improved by incorporating 12 to 35 parts by weight of a plastic pigment per 100 parts by weight of the total pigments of the overcoating composition.

The desirable plastic pigments are those made of heat-fusible materials such as polyolefins including polystyrene, polyethylene and polypropylene. Their particle size is selected by taking into account a mutually contradictory relationship between the desired paper gloss and the picking resistance. Though not specially critical, its size is preferably smaller than the size of other pigments to be used therewith. A suitable size of the plastic pigment is 2μ or smaller, preferably less than 1μ. Such plastic pigments are commercially available under registered trademarks of "Lytron" (supplied by Monsanto Co., U.S.A) and "XD-7226" (supplied by Dow Chemical Co., U.S.A).

The favorable effect of a plastic pigment is exhibited appreciably when the amount incorporated in 100 parts by weight of total pigments is about 5 parts by weight and exhibited markedly when the incorporated amount is 12 to 35 parts by weight.

It has been known that the use of plastic pigments improves gloss, opacity, brightness and smoothness of the coated paper. In the method of this invention, the favorable effect of plastic pigments is further enhanced by incorporating them in a specified amount into the pigment component of the overcoating composition and applying it to the under-coated paper. Enhancement of such effect is developed by the flattening of plastic pigment particles existing between particles of other pigments when the coating layer is pressed against a heated roll to effect mirror finish.

The polymer latices to be used are those having Tg of 38° C. or higher such as, for example, polyvinyl acetate emulsions, styrene-isoprene copolymer emulsions, styrene-butadiene latices, acrylic polymer emulsions and a mixture thereof. The polymer latices are used in an amount of generally 10 to 40 parts, preferably 15 to 30 parts by weight of polymer for 100 parts by weight of pigments. The solids of the aqueous coating composition for overcoating is in the range of 40 to 70% depending on the type of coater to be employed.

According to the required quality of the finished cast-coated paper, the afore-mentioned binders, defoamers, dyes and flow modifiers or other agents for undercoating may be incorporated in the overcoating compositions, unless characteristics of the final product are deteriorated.

The coaters to be employed for applying the overcoating composition are those customarily used in manufacturing pigment-coated paper such as blade coater, roll blade coater, air-knife coater, roll coater, brush coater, curtain coater, Champflex coater, bar coater and gravure coater. Of these, blade coater is particularly preferred in view of the specular glossiness of the product. To obtain a more improved quality of finish, it is feasible to apply multiple coating layers by means of one or more coater types. A suitable coating weight of the overcoating is in the range of generally 10 to 40 g/m$^2$, preferably 10 to 30 g/m$^2$.

The pigment-coated paper thus applied with the overcoating is then dried in the same manner as in the drying of undercoating, except that the temperature should be lower than Tg of the polymer latex used as binder and contained in the overcoating composition. If the overcoating layer is heated at a temperature higher than Tg, the pigment and the polymer latex are firmly bound together by fusion of the polymer during the drying step and it becomes impossible to obtain a cast-coated paper having a high gloss, as measured at an angle of incidence of 20°, even if treated thereafter with a heated calender or any other mirror finishing means. The moisture content of the coated paper will be about 3 to 9% after the drying step.

The dried pigment-coated paper is then subjected to mirror finishing treatment at a temperature higher than Tg of the polymer latex by means of a calendering apparatus provided with heated polished rolls or cylinders to impart high gloss to the coated paper.

In the method of this invention, the mirror finish is effected by means of a calendering apparatus provided with heated polished rolls or cylinders or an apparatus commonly used in manufacturing art papers or coated papers to impart gloss or smoothness such as a gloss calender or super calender. It is also possible to use any other equipments which can heat the coated paper at a temperature higher than Tg of the polymer latex, preferably by 30° to 130° C. and which can press the coated paper against a heated polished surface. Since surface temperature and linear pressure of the calender puts limitation on the finishing speed, it is desirable to use an equipment enabling to give a linear pressure of at least 20 kg/cm, particularly 40 to 190 kg/cm, and a surface temperature of 100° to 200° C., preferably 120° to 180° C.

The mirror finishing of paper according to this invention is effected by the procedure described above. The both-side cast-coated paper can be produced by conducting the above procedure on one side and then repeating the procedure on the other side to produce substantially identical gloss on both sides.

There has been known a method for manufacturing glossy paper, which comprises undercoating a paper stock with an aqueous paper coating composition comprising starch and China clay at a coating weight of 3.8 g/m$^2$ per side on dry basis, then applying to the undercoated paper an aqueous coating composition containing paper coating pigments and a polymer latex having Tg of 38° C. or higher, drying the coated paper at a temperature below Tg, and subjecting it to mirror finishing treatment at a temperature higher than Tg (U.S. Pat. No. 3,873,345).

However, as already described, it was ascertained by examination that an undercoating of a coating weight less than 5 g/m$^2$ per side cannot yield satisfactory cast-coated paper having a gloss of 15% or more, as measured at an angle of incidence of 20°, and that in order to obtain a satisfactory cast-coated paper it is necessary that the coating weight of the undercoating be 5 to 25, preferably 8 to 20 g/m² and at least one undercoating layer be applied by means of a blade coater.

The glossy paper obtained by the above-noted known method shows a gloss of 70 to 90%, as measured at a large angle of incidence of 75°, which is higher than that of common art papers and comparable to that of cast-coated papers; whereas when the angle of incidence is 20°, the gloss is somewhat higher than that of common art paper but never exceeds 15%.

According to this invention, there is no need to install a special equipment for the manufacture of cast-coated paper, but a common coater for use in manufacturing common pigment-coated papers (art paper and coated paper) can produce high-quality cast-coated paper at a low cost.

Consequently, the method of this invention has an important advantage in that already installed coating equipments can be fully utilized. If the type and number of already installed equipments permit, it is possible to produce both-side cast-coated paper in single step and also, of course, to produce single-side cast-coated paper.

Other advantages of this invention are: cast-coated paper can be produced at a high speed of 200 to 800 m/sec. which is comparable to the manufacturing speed of common pigment-coated paper; there is no occurrence of blistering, because a desirable water vapor permeability is assured by the use of a hard polymer latex having Tg of 38° C. or higher; the finished surface is hardly subjected to damage due to rubbing or scratching; the ink gloss and surface smoothness can be further improved by the incorporation of plastic pigments in the overcoating composition.

The invention is further illustrated below with reference to Examples, but the invention is not limited thereto.

In Examples all parts and percents are by weight.

The gloss were measured by the measurement at angles of incidence of 75° and 20° according to the method specified in JIS Z 8741 by using a paper gloss tester supplied by Nippon Rigaku Co.

The ink gloss was determined by testing the 60° gloss according to the method of JIS Z8741 on the specimens prepared by coating with a prescribed quantity of the ink by the identical procedure.

The smoothness was tested by means of a smoothness tester of the air micrometer type supplied by Toei Denshi Kogyo Co., in which the volume of air flowing between the measuring head and the paper surface is converted into a pressure head of mercury. Accordingly, the smaller the reading, the better the smoothness.

EXAMPLES 1 to 3 and REFERENCE EXAMPLES 1 and 2

A coating composition containing the following components was prepared for use as undercoating composition:

| | Parts |
|---|---|
| Kaolin | 90 |
| Ground calcium carbonate | 10 |
| Sodium pyrophosphate | 0.1 |
| Styrene-butadine latex (Tg = 5° C.) | 12 |
| Oxidized starch | 8 |
| Solids of coating composition (aqueous medium) | 60% |

A paper stock of 78 g/m² basis weight was coated on one side with the above undercoating composition at a rate of 5 g/m² on solids basis by means of a blade coater and dried in hot air to 5% moisture content. In the same manner, the other side of the paper stock was also coated with the undercoating composition and dried.

To one side of the undercoated paper, was applied by means of a blade coater each 18 g/m² (solids basis) of the aqueous overcoating compositions (50% solids) shown in Table 1 (3 Examples and 2 Reference Examples). The coating was dried by passing through an air cap drier heated at about 120° C. under such conditions that the temperature of coated paper may not exceed 38° C. by taking into account of the evaporative cooling.

The dried coated paper was passed through a gloss-calender provided with 6 pressure rolls under such conditions that the linear pressure of each pressure roll is 80 kg/cm and the surface temperature of the gloss calender is 160° C. The other side of the coated paper was similarly treated.

The 75° and 20° gloss of each coated paper were as shown in Table 2. The cast-coated papers obtained in Examples 1 to 3 according to this invention showed 20° gloss exceeding 15%, whereas those obtained in Reference Examples 1 and 2 showed very low 20° gloss, though 75° gloss were comparable to those of conventional art papers.

TABLE 1

| | Example (Parts) | | | Reference Example (Parts) | |
|---|---|---|---|---|---|
| | 1 | 2 | 3 | 1 | 2 |
| Kaolin | 80 | 80 | 80 | 80 | 80 |
| Precipitated calcium carbonate | 10 | | | 10 | |
| Ground calcium carbonate | | 20 | 10 | | 20 |
| Plastic pigment | 10 | | 10 | 10 | |
| Oxidized starch | 1 | | 1 | 1 | |
| Phosphorylated starch | | 1 | | | 1 |
| Styrene-butadiene latex Tg = 40° C. | 15 | | | | |
| Styrene-butadiene latex Tg = 60° C. | | 20 | | | |
| Styrene-butadiene latex Tg = 18° C. | | | | 15 | |
| Styrene-butadiene latex Tg = 5° C. | | | | | 20 |
| Acrylic polymer emulsion Tg = 60° C. | | | 15 | | |

TABLE 2

| | | Example | | | Reference Example | |
|---|---|---|---|---|---|---|
| | | 1 | 2 | 3 | 1 | 2 |
| Paper gloss (%) | 75° | 82 | 85 | 88 | 78 | 82 |
| | 20° | 25 | 20 | 18 | 3 | 2 |

EXAMPLE 4 and REFERENCE EXAMPLE 3

A coating composition containing the following components was prepared for use as undercoating composition:

| | Parts |
|---|---|
| Kaolin | 80 |
| Ground calcium carbonate | 20 |

-continued

| | Parts |
|---|---|
| Sodium pyrophosphate | 0.1 |
| Styrene-butadiene latex (Tg = −5° C.) | 12 |
| Oxidized starch | 5 |
| Solids (aqueous medium) | 60% |

A paper stock of 60 g/m² basis weight was coated with the above undercoating composition at a rate of 10 g/m² (solids basis) per side and dried in the same manner as in preceding Examples to prepare dried both-side undercoated paper.

To the undercoated paper, was applied by means of an air knife coater 10 g/m² (solids basis) per side of the overcoating composition of Example 1. In the same manner as in the preceding Examples, both-side cast-coated paper was prepared.

In Reference Example 3, the paper stock was directly coated with the overcoating composition of Example 1 at a rate of 20 g/m² (solids basis) per side by means of an air knife coater and both-side coated paper was prepared.

The 75° gloss of both coated papers of Example 4 and Reference Example 3 were 83% and 82%, respectively, which were substantially identical, whereas the 20° gloss were 18% and 8%, respectively, indicating that only the coated paper of Example 4 corresponds to a cast-coated paper.

EXAMPLE 5 and REFERENCE EXAMPLE 4

Procedures of Example 1 and Reference Example 1 were repeated, recept that coating weight of the undercoating and overcoating were both 15 g/m² (solids basis).

The results of comparison of the gloss of these coated papers were those of commercial cast-coated papers and art papers were as shown in Table 3. The cast-coated paper of Example 5 according to this invention was comparable to the commercial products and is distinguishable from commercial art papers and the coated paper of Reference Example 4.

TABLE 3

| | 75° Gloss (%) | 20° Gloss (%) |
|---|---|---|
| Example 5 | 90 | 33 |
| Reference Example 4 | 82 | 5 |
| Commercial cast-coated paper A | 84 | 32 |
| Commercial cast-coated paper B | 77 | 19 |
| Commercial art paper A | 53 | 1 |
| Commercial art paper B | 60 | 2 |
| Commercial high-grade art paper | 72 | 6 |

EXAMPLES 6 to 9

A coating composition containing the following components was prepared for use as undercoating composition:

| | Parts |
|---|---|
| Kaolin | 100 |
| Sodium pyrophosphate | 0.1 |
| Styrene-butadiene latex (Tg = 5° C.) | 12 |
| Phosphorylated starch | 5 |
| Solids coating composition (aqueous medium) | 60% |

A paper stock of 78 g/m² basis weight was coated on one side with the above undercoating composition at a rate of 5 g/m² on solids basis by means of a blade coater and dried in hot air to 5% moisture content. In the same manner, the other side of the paper stock was also coated with the undercoating composition and dried. To one side of the undercoated paper, was applied by means of a blade coater each 20 g/m² on solids basis of the aqueous overcoating composition (50% solids) shown in Table 4. The coating was dried by passing through an air cap drier heated at about 120° C. under such conditions that the temperature of coated paper may not exceed 38° C. by taking into account of the evaporative cooling. The dried coated paper was mirror finished by passing through a gloss calender provided with 6 pressure rolls under such conditions that the linear pressure of each pressure roll is 80 kg/cm and the surface temperature of the gloss calender is 160° C. The other side of the coated paper was similarly treated.

The 75° and 20° gloss, smoothness and ink gloss of the resulting coated paper were as shown in Table 5.

As is apparent from Table 5, with the increase in the amount of plastic pigment in the overcoating composition, both the 60° ink gloss and the 20° paper gloss are markedly increased and the smoothness is improved. In view of the 60° ink gloss and the 20° paper gloss, it is desirable that the plastic pigment content of the overcoating composition be 10% or more.

TABLE 4

| | Example | | | |
|---|---|---|---|---|
| | 6 | 7 | 8 | 9 |
| Kaolin | 100 | 90 | 80 | 70 |
| Sodium pyrophosphate | 0.1 | 0.1 | 0.1 | 0.1 |
| Lytron RX-1259* | | 10 | 20 | 30 |
| SBR latex** (Tg = 40° C.) | 20 | 20 | 20 | 20 |

Note:
*A plastic pigment of Monsanto Chemical Co. (polystyrene; 0.5 μ in particle diameter).
**Styrene-butadiene copolymer latex.

TABLE 5

| | Example | | | |
|---|---|---|---|---|
| | 6 | 7 | 8 | 9 |
| Smoothness, mmHg | 13 | 6 | 5 | 3 |
| 75° paper gloss, % | 85 | 86 | 88 | 91 |
| 20° paper gloss, % | 16 | 23 | 30 | 35 |
| 60° Ink gloss, % | 80.0 | 85.9 | 91.0 | 93.2 |

REFERENCE EXAMPLE 5

The procedure of Example 8 was repeated, except that the paper stock was directly coated by means of a blade coater with the overcoating composition of Example 8 at a rate of 25 g/m² on solids basis per side. The properties of the resulting glossy paper together with those of Example 8 are shown in Table 6.

TABLE 6

| | Example 8 | Reference Example 5 |
|---|---|---|
| Smoothness | 5 | 7 |
| 75° Paper gloss, % | 88 | 85 |
| 20° Paper gloss, % | 30 | 10 |

TABLE 6-continued

| | Example 8 | Reference Example 5 |
|---|---|---|
| 60° Ink gloss, % | 91.0 | 90.2 |

EXAMPLES 10 to 12

Procedures of Examples 7 to 9 were repeated, except that the coating weight of the undercoating composition was 10 g/m$^2$ on solids basis per side and the overcoating composition was applied by means of an air knife coater. Examples 10, 11 and 12 correspond to Examples 7, 8 and 9, respectively. The properties of the resulting cast-coated papers were compared with those of commerical glossy papers as shown in Table 7.

TABLE 7

| | 75° paper gloss (%) | 20° paper gloss (%) | 60° Ink gloss (%) | Smoothness (mmHg) |
|---|---|---|---|---|
| Example 10 | 89 | 22 | 82.4 | 10 |
| Example 11 | 90 | 27 | 85.6 | 8 |
| Example 12 | 92 | 33 | 87.4 | 5 |
| Commercial cast-coated paper A | 84 | 32 | 67.0 | 4 |
| Commercial cast-coated paper B | 77 | 19 | 62.5 | 11 |
| Commercial art paper A | 53 | 1 | 78.5 | 13 |
| Commercial Art paper B | 60 | 2 | 65.2 | 22 |
| Commercial high-grade art paper | 72 | 6 | 92.5 | 9 |

EXAMPLES 13 and 14 and REFERENCE EXAMPLE 6

Cast-coated papers were prepared in the same manner as in Example 3, except that the coating weight of both undercoating and overcoating were varied. In Reference Example 6, Example 13 and Example 4, the coating weight on dry basis of undercoating were 4, 7 and 10 g/m$^2$, respectively, and those of overcoating were 19, 16 and 13 g/m$^2$, respectively. The properties of the resulting coated papers were as shown in Table 8.

TABLE 8

| | Example 13 | Example 14 | Reference Example 6 |
|---|---|---|---|
| Smoothness, mmHg | 3 | 2 | 12 |
| 75° Paper gloss, % | 89 | 92 | 85 |
| 20° Paper gloss, % | 24 | 28 | 12 |
| 60° Ink gloss, % | 85 | 86 | 84 |

REFERENCE EXAMPLE 7

In Reference Example 7, the procedure of Example 14 was repeated, except that the undercoating was applied by means of an air knife coater. The properties of coated papers obtained in Example 14 and Reference Example 7 were as shown in Table 9.

TABLE 9

| | Example 14 | Reference Example 7 |
|---|---|---|
| Smoothness, mmHg | 2 | 8 |
| 75° Paper gloss, % | 92 | 89 |
| 20° Paper gloss, % | 28 | 13 |
| 60° Ink gloss, % | 86 | 84 |

What is claimed is:

1. A method for manufacturing cast-coated paper, which comprises applying at least one undercoating of an aqueous coating composition containing coating pigments and a binder to at least one side of the base paper to form at least one undercoating layer, at least one of the undercoatings being applied by means of a blade coater and the application rate of the undercoating being 5 to 25 g/m$^2$ on dry basis per side; then applying onto the undercoating layer an overcoating of an aqueous coating composition containing coating pigments in an amount of 12 to 35 parts by weight of a plastic pigment per 100 parts by weight of the total pigments and a polymer latex having a glass transition temperature of 38° C. or higher; drying the overcoating at a temperature below the glass transition temperature of the polymer latex; and subjecting it to a mirror finishing treatment at a temperature higher than said glass transition temperature to obtain a cast-coated paper having a specular gloss greater than 15% at an angle incidency, of 20° to the normal of the paper.

2. A method according to claim 1, wherein the application rate of the undercoating is 8 to 20 g/m$^2$ on dry basis per side.

3. A method according to claim 1, wherein the plastic pigment has a particle diameter of 2$\mu$ or less.

4. A method according to claim 1, wherein the polymer latex having a glass transition temperature of 38° C. or higher is an emulsion of polyvinyl acetate, styrene-isoprene copolymer, styrene-butadiene copolymer, an acrylic polymer or a mixture thereof.

5. A method according to claim 1, wherein the application rate of the overcoating is 10 to 40 g/m$^2$ on dry basis per side.

6. A method according to claim 1, wherein the mirror finishing treatment is carried out at a temperature of 100° to 200° C.

7. A method according to claim 1, wherein the mirror finishing treatment is carried out by means of a heated calender under a linear pressure of 20 kg/cm or more.

8. A method according to claim 1, wherein the mirror finishing treatment is carried out by means of a heated calender at a temperature of 120°–180° C. and under a linear pressure of 40 to 190 Kg/cm.

9. A cast-coated paper manufactured by the method according to claim 1.

* * * * *